US011109669B2

(12) United States Patent
Huang

(10) Patent No.: US 11,109,669 B2
(45) Date of Patent: Sep. 7, 2021

(54) BRUSH ASSEMBLY AND MULTIFUNCTIONAL BRUSH PROTECTOR THEREOF

(71) Applicant: Tsung-Rey Huang, Taipei (TW)

(72) Inventor: Tsung-Rey Huang, Taipei (TW)

( * ) Notice: Subject to any disclaimer, the term of this patent is extended or adjusted under 35 U.S.C. 154(b) by 294 days.

(21) Appl. No.: 16/373,661

(22) Filed: Apr. 3, 2019

(65) Prior Publication Data

US 2020/0315338 A1 Oct. 8, 2020

(51) Int. Cl.

| | |
|---|---|
| ***A46B 17/04*** | (2006.01) |
| ***A46B 17/06*** | (2006.01) |
| ***A47K 1/09*** | (2006.01) |

(52) U.S. Cl.

CPC ..... *A46B 17/04* (2013.01); *A46B 17/06* (2013.01); *A47K 1/09* (2013.01); *A46B 2200/1046* (2013.01)

(58) Field of Classification Search

CPC ..... A46B 17/02; A46B 17/04; A46B 17/06; A46B 15/0095; A46B 15/0097; A46B 15/0055; A46B 2200/1046; A46B 17/00; A46B 2200/202; A47K 1/09; B44D 3/123; B44D 3/006; A45D 27/46; A45D 27/29

USPC ..... 15/247; D32/35; D9/444, 455, 436; 211/65–66; 248/110–111

See application file for complete search history.

(56) References Cited

U.S. PATENT DOCUMENTS

| | | | | |
|---|---|---|---|---|
| 1,128,984 A * | 2/1915 | Holtzman | A46B 5/0095 | 206/361 |
| 2,079,285 A * | 5/1937 | Grean | A45D 27/04 | 248/110 |
| 4,847,939 A * | 7/1989 | Derencsenyi | A46B 17/04 | 15/246 |
| 7,401,614 B2 * | 7/2008 | Ruzumna | B44D 3/006 | 134/135 |
| D661,907 S * | 6/2012 | Birkland | D4/199 | |
| 8,668,085 B1 * | 3/2014 | Oliver | A46B 17/04 | 206/361 |
| 9,848,723 B1 * | 12/2017 | Huang | A46B 17/08 | |
| 9,888,764 B2 * | 2/2018 | Xavier | A46B 17/06 | |
| 9,995,326 B2 * | 6/2018 | Di Monte | F16B 2/22 | |
| 2014/0332642 A1 * | 11/2014 | Lim | A46B 17/04 | 248/111 |

FOREIGN PATENT DOCUMENTS

WO WO 2016/080567 A1 * 5/2016 ..... A46B 17/00

* cited by examiner

*Primary Examiner* — Laura C Guidotti

(74) *Attorney, Agent, or Firm* — Li & Cai Intellectual Property Office

(57) ABSTRACT

A brush assembly and a multifunctional brush protector thereof are provided. The multifunctional brush protector includes a sleeve body, an elastic tightening portion and a supporting portion. The sleeve body has a first open end, a second open end corresponding to the first open end, and an accommodating space arranged between the first open end and the second open end. The sleeve body has an outer surface provided with a first washing texture. The elastic tightening portion is formed at the first open end. The supporting portion is formed at the second open end for allowing the sleeve body to be in an upright state, and includes a plurality of retaining pieces that are disposed at an inner periphery of the second open end and extend along a radial direction.

19 Claims, 10 Drawing Sheets

BRUSH ASSEMBLY AND MULTIFUNCTIONAL BRUSH PROTECTOR THEREOF

CROSS-REFERENCE TO RELATED PATENT APPLICATION

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a brush protector, and more particularly to a multifunctional brush protector for a makeup brush and a brush assembly using the same.

BACKGROUND OF THE DISCLOSURE

Makeup makes people look better and more attractive. Studies have shown that women with cosmetics not only increase in charm and favorability for men, but indirectly increase in personal confidence with increased satisfaction to their appearance. Nowadays, makeup is no longer a requirement for women. Many men may want to have a light makeup to give people a good look.

Makeup brushes, which can be used to apply the powder foundation and modify the facial appearance, are the important tools for people who often wear cosmetics. Although there are many types of makeup brushes for different uses, these makeup brushes are basically composed of a brush head with brush hairs and a handle. Once the makeup brush is not completely cleaned, cosmetics and sebum absorbed on the brush hairs would cause a heavy growth of bacteria; and this is harmful the facial skin. In addition, users often put the makeup brush in a cosmetic bag for carrying it out conveniently. In this situation, the makeup brush may get dirty and the brush hairs are disorganized. In addition, the makeup brush is often placed in a random manner in use. In this situation, the makeup brush is not only inconvenient to use, but have health concerns, especially in public places.

Although the conventional protective cover or elastic protective net has a protecting function for the brush head of the cosmetic brush, it still has technical inadequacies.

SUMMARY OF THE DISCLOSURE

In response to the above-referenced technical inadequacies, the present disclosure provides a multifunctional brush protector which can increase the flexibility of use of a brush and a brush assembly using the same.

In one aspect, the present disclosure provides a multifunctional brush protector which includes a sleeve body, an elastic tightening portion and a supporting portion. The sleeve body has a first open end, a second open end corresponding to the first open end, and an accommodating space arranged between the first open end and the second open end, wherein the sleeve body has an outer surface provided with a first washing texture. The elastic tightening portion is formed at the first open end. The supporting portion is formed at the second open end and includes a plurality of retaining pieces that are disposed at an inner periphery of the second open end and extend along a radial direction. The sleeve body is configured to be held in an upright state by the supporting portion.

In one aspect, the present disclosure provides a brush assembly which includes a brush and a multifunctional brush protector. The brush includes a brush head and a holding portion connecting to the brush head. The multifunctional brush protector is configured to work with the brush and includes a sleeve body, an elastic tightening portion and a supporting portion. The sleeve body has a first open end, a second open end corresponding to the first open end, and an accommodating space arranged between the first open end and the second open end, wherein the sleeve body has an outer surface provided with a first washing texture. The elastic tightening portion is formed at the first open end. The supporting portion is formed at the second open end and includes a plurality of retaining pieces that are disposed at an inner periphery of the second open end and extend along a radial direction. The sleeve body is configured to be held in an upright state by the supporting portion. The multifunctional brush protector is configured to wash the brush head of the brush by the first washing texture, and the brush head of the brush is configured to be received in the accommodating space from the first open end.

One of the advantages of the present disclosure is that the multifunctional brush protector of the present disclosure, in which the sleeve body has a first open end and a second open end and an outer surface thereof is provided with a first washing texture, and the elastic tightening portion and the supporting portion are respectively formed at the first open end and the second open end and the supporting portion includes a plurality of retaining pieces that are disposed at an inner periphery of the second open end and extend along a radial direction, can increase the flexibility of use of the brush, prevent the brush head 21 from coming in contact with dust, dirt and other debris, and, before use, prevent the brush hairs of the brush head 21 from being deformed and disorganized.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
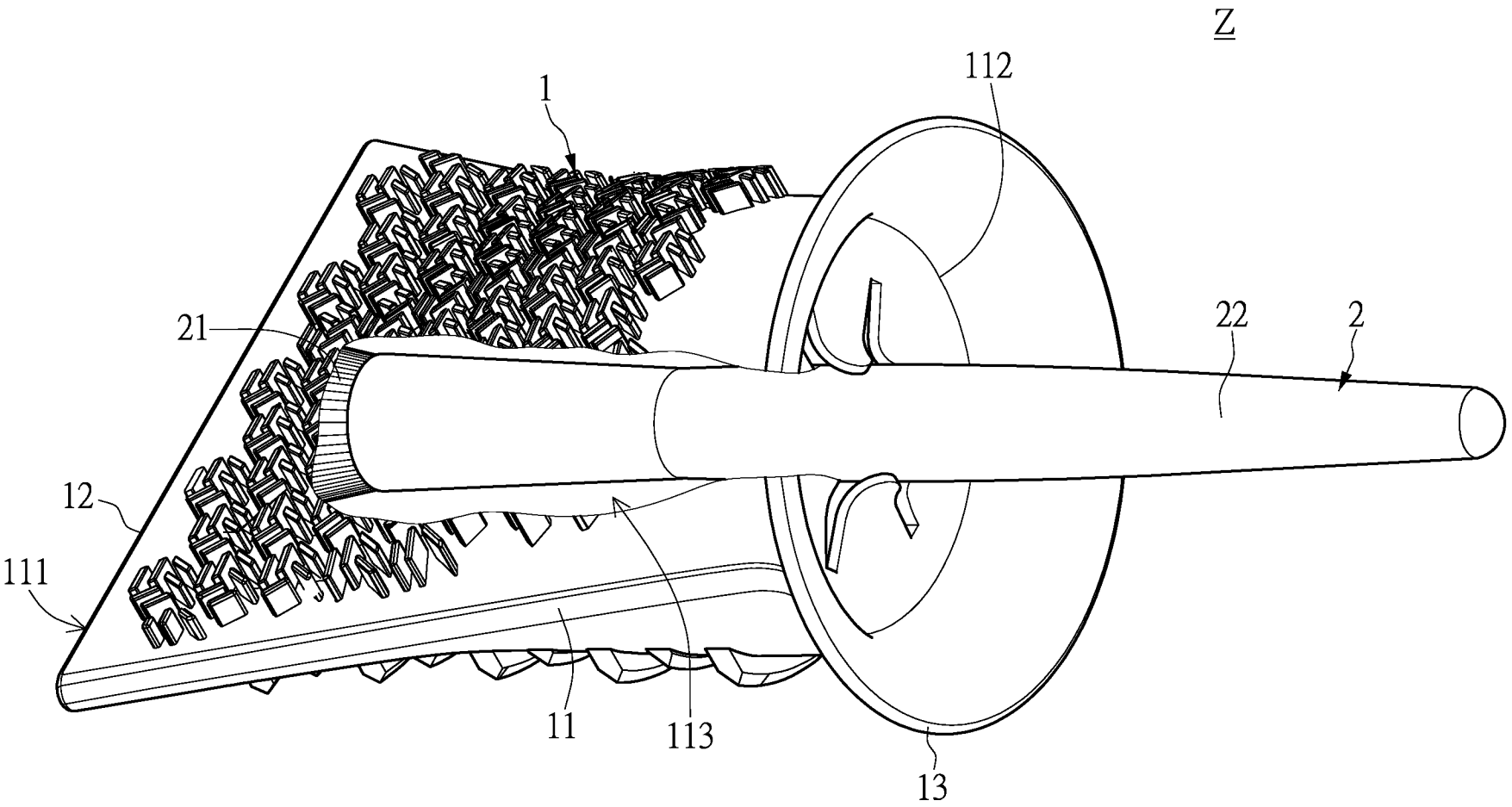
FIG. 1 is a perspective view of a brush assembly of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 5, the embodiments of the present disclosure provides a multifunctional brush protector 1 which includes a sleeve body 11, an elastic tightening portion 12 and a supporting portion 13. In the present embodiment, the multifunctional brush protector 1 can be made of silicone and be processed to a predetermined three-dimensional shape and size by a forming mold, but the present disclosure is not limited thereto.

Figure 2:
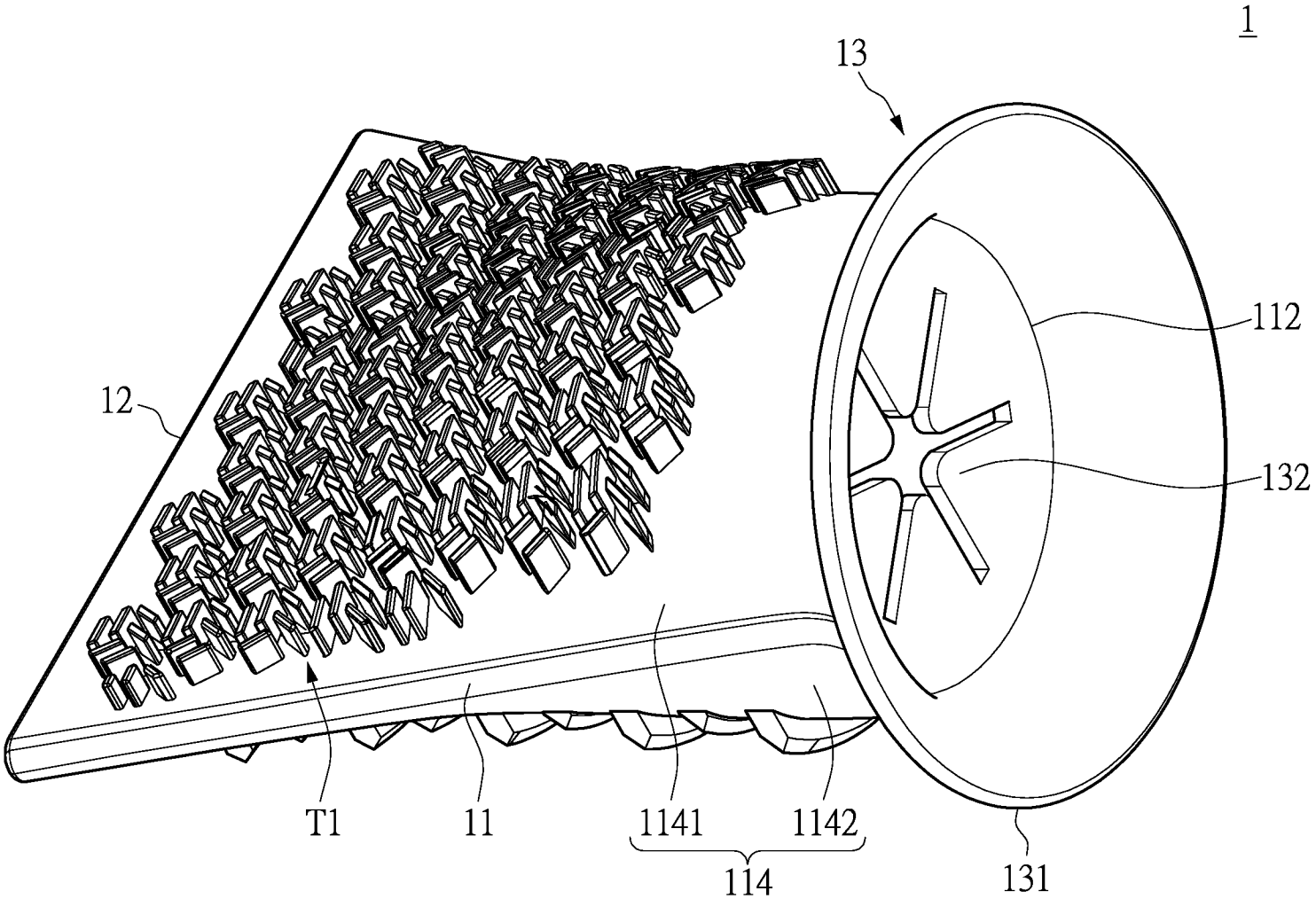
FIG. 2 is a perspective view of a multifunctional brush protector of the present disclosure.
Figure 3:
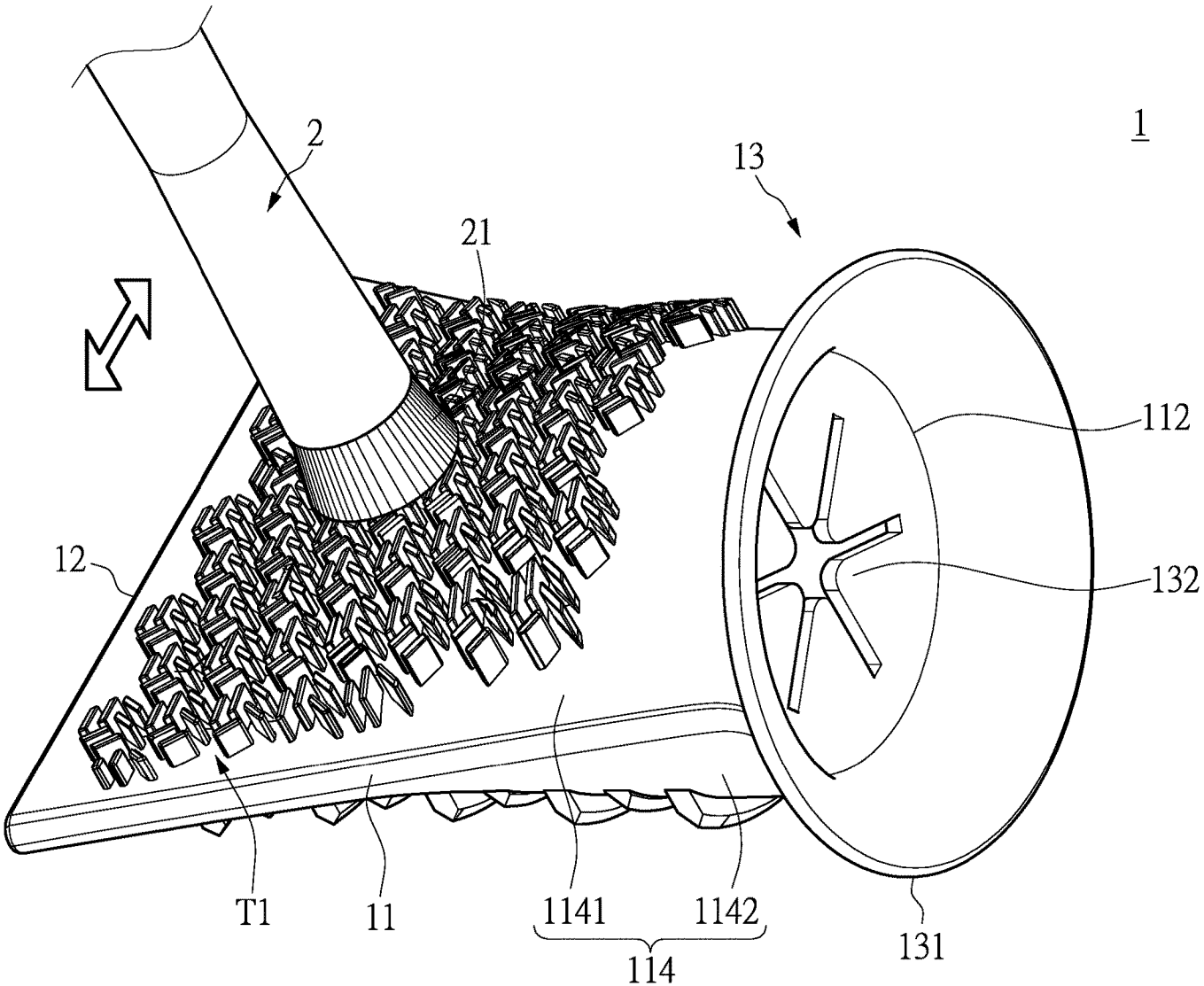
FIG. 3 is a schematic view showing a use state of the multifunctional brush protector of the present disclosure.
Figure 4:
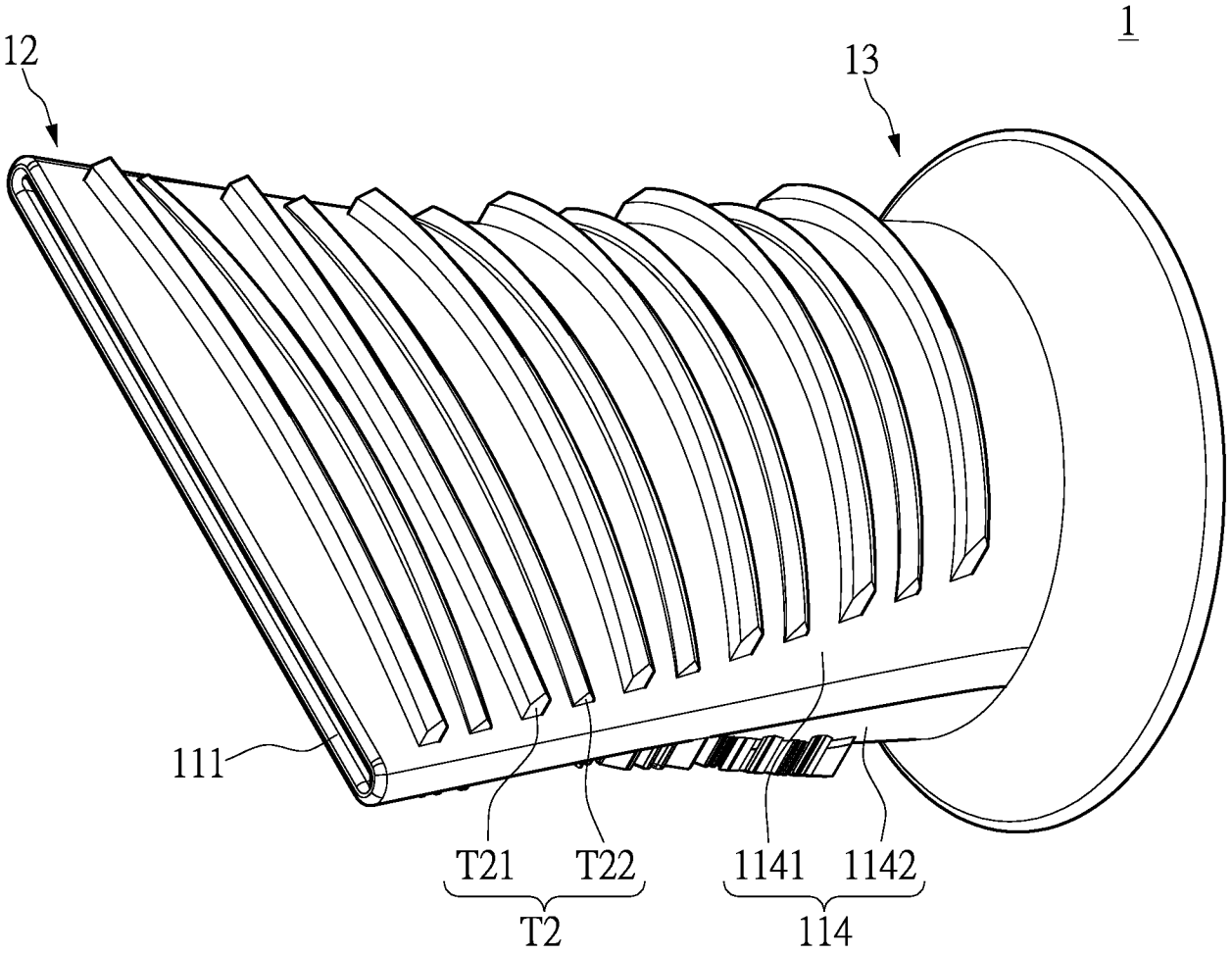
FIG. 4 is another perspective view of the multifunctional brush protector of the present disclosure.

The sleeve body 11 has a first open end 111 and a second open end 112 corresponding to the first open end. The sleeve body 11 defines an accommodating space 113 that is arranged between the first open end 111 and the second open end 112 for receiving a brush head 21 of a brush 2. It should be noted that the sleeve body 11 has an outer surface 114 provided with a first washing texture T1, as shown in FIG. 2 and FIG. 3, for washing the brush head 21 of the brush 2. More specifically, the outer surface 114 of the sleeve body 11 can have a first surface region 1141 and the first washing texture T1 is formed on the first surface region 1141. Accordingly, the brush head 21 can move reciprocally on the first surface region 1141 along a predetermined direction while applying a cleaning fluid such as water, so that cosmetics adhered on the brush head 21 can be efficiently removed by the first washing texture. The above described movement of the brush head 21 is merely an example and is not meant to limit the present disclosure. In use, the brush head 21 can move freely in all directions.

Preferably, the outer surface 114 of the sleeve body 11 can have a second surface region 1142. The second surface region 1142 can be opposite to the first surface region 1141 and provided with a second washing texture T2. Accordingly, the brush head 21 can move on the second surface region 1142 along an arrangement direction of the second washing texture T2 to clean brush hairs on outer side and root portions of the brush head 21. It should be noted that, when the brush head 21 moves along the arrangement direction of the second washing texture T2, the second washing texture T2 can press the brush head 21 to remove water out of the brush hairs. That is to say, the second washing texture T2 also has a water removing function.

Figure 6:
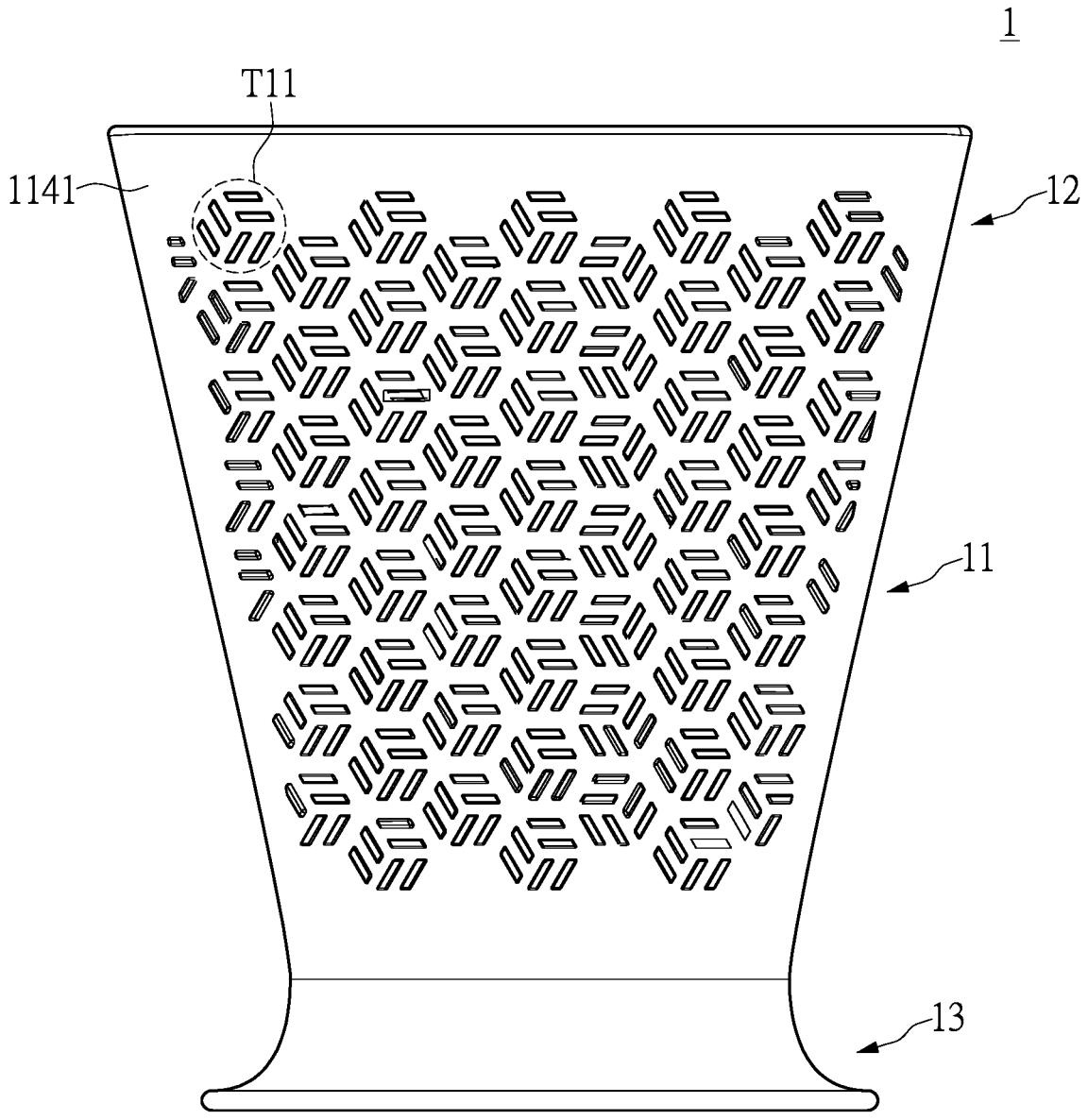
FIG. 6 is a planar view of the multifunctional brush protector of the present disclosure.
Figure 10:
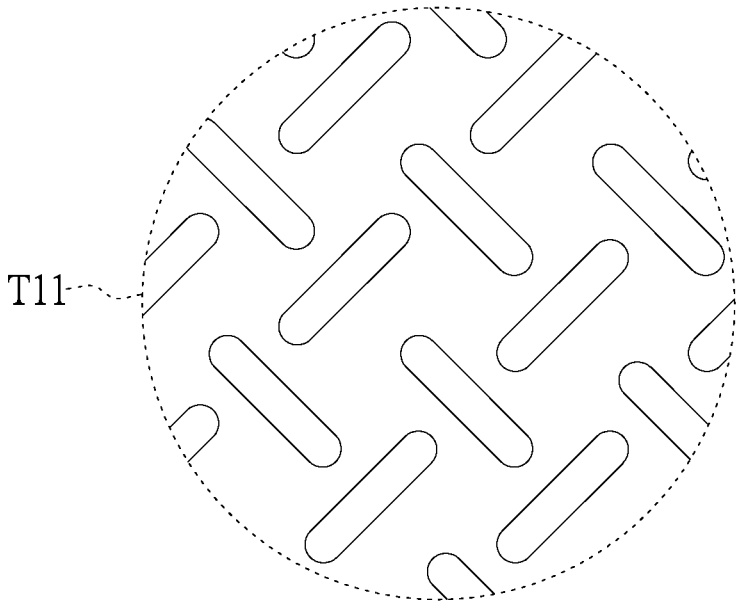
FIG. 10 is a schematic view showing a first washing texture of the multifunctional brush protector of the present disclosure.
Figure 11:
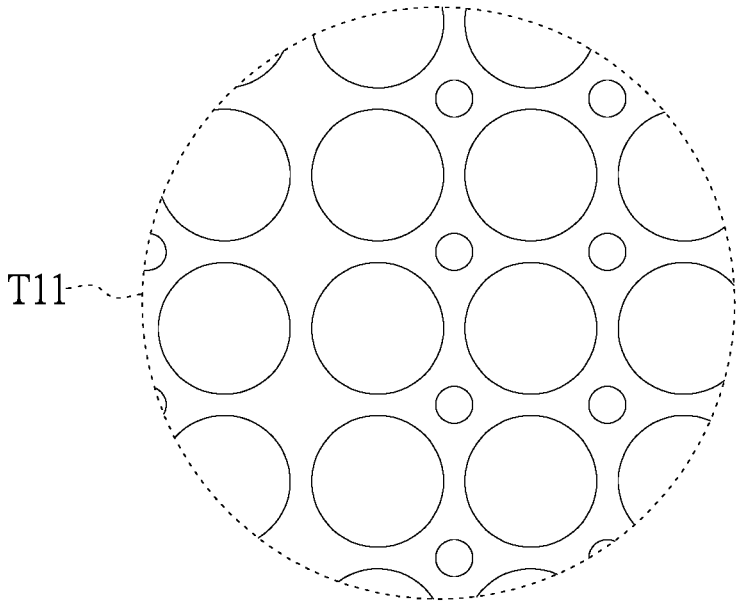
FIG. 11 is another schematic view showing a first washing texture of the multifunctional brush protector of the present disclosure.

In the present embodiment, the first washing texture T1 can include a plurality of first washing texture units T11 uniformly distributed on the first surface region 1141, and each of the first washing texture units T11 includes a plurality of tiny protrusions T111 spaced apart from each other, as shown in FIG. 6 and FIG. 10. The tiny protrusion T111 can be a tiny piece, but is not limited thereto. More specifically, the number of the tiny protrusions T111 of each of the first washing texture unit T11 can be four, wherein two of the tiny protrusions T111 extend along a first direction (e.g., horizontal direction), and the other two of the tiny protrusions T111 extend along a second direction (e.g., inclined direction) that is different from the first direction. However, the above described first washing texture T1 on the outer surface 114 of the sleeve body 11 is merely an example and is not meant to limit the present disclosure. The first washing texture T1 can include a plurality of different types of convex dots that are arranged along a specific direction, as shown in FIG. 11.

In addition, the second washing texture T2 can include a plurality of convex ribs extending along a width direction of the sleeve body 11 and spaced apart from each other for cleaning the brush hairs on outer side and root portions of the brush head 21. The convex ribs can include a plurality of first convex ribs T21 and a plurality of second convex ribs T22 alternately arranged with the first convex ribs T21, and the first convex ribs T21 have a bigger size (i.e., height and width) than the second convex ribs T22. However, the above described second washing texture T2 on the outer surface 114 of the sleeve body 11 is merely an example and is not meant to limit the present disclosure.

In consideration of usability, the sleeve body 11 has a tapered shape along a direction from the second open end 112 to the first open end 111. The sleeve body 11 increases in thickness along the direction from the second open end 112 to the first open end 111.

The elastic tightening portion 12 is formed at the first open end 111 of the sleeve body 11 for positioning the brush 2. More specifically, the elastic tightening portion 12 can retain the brush head 21 of the brush 2 in the sleeve body 11. When the brush head 21 is received in the accommodating space 113, it can be restricted by the elastic tightening portion 12 from falling out through the first open end 111. In the present embodiment, the elastic tightening portion 12 can be integrally formed at the first open end 111, but is not limited thereto.

Figure 7:
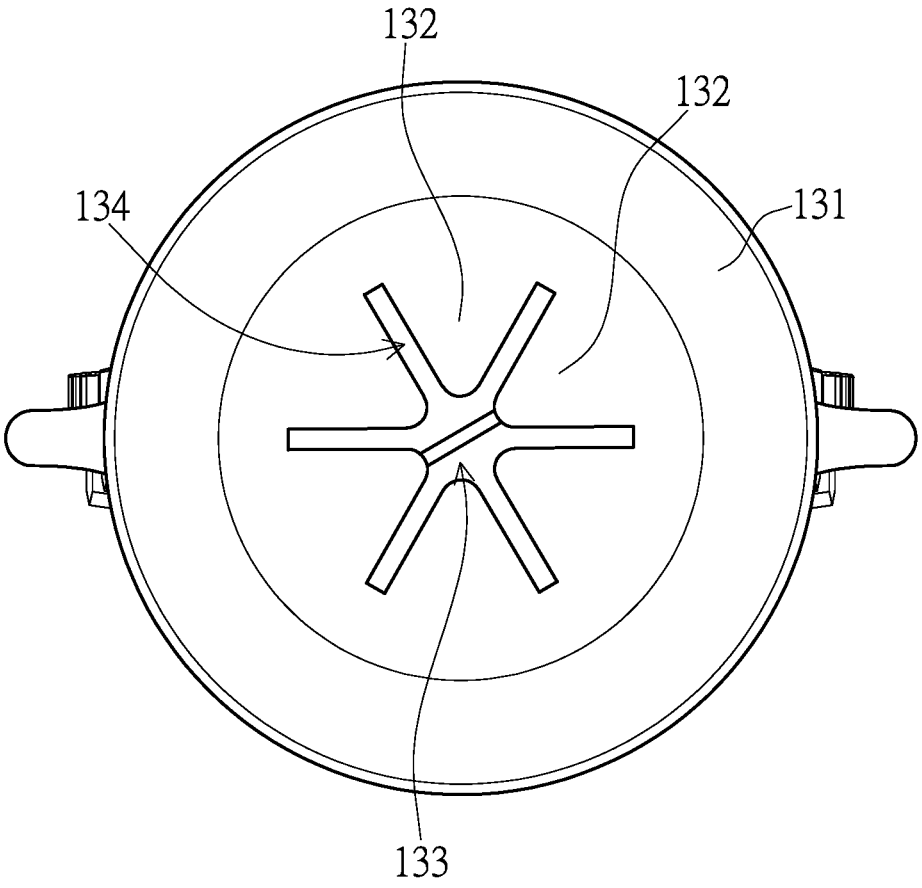
FIG. 7 is another planar view of the multifunctional brush protector of the present disclosure.
Figure 8:
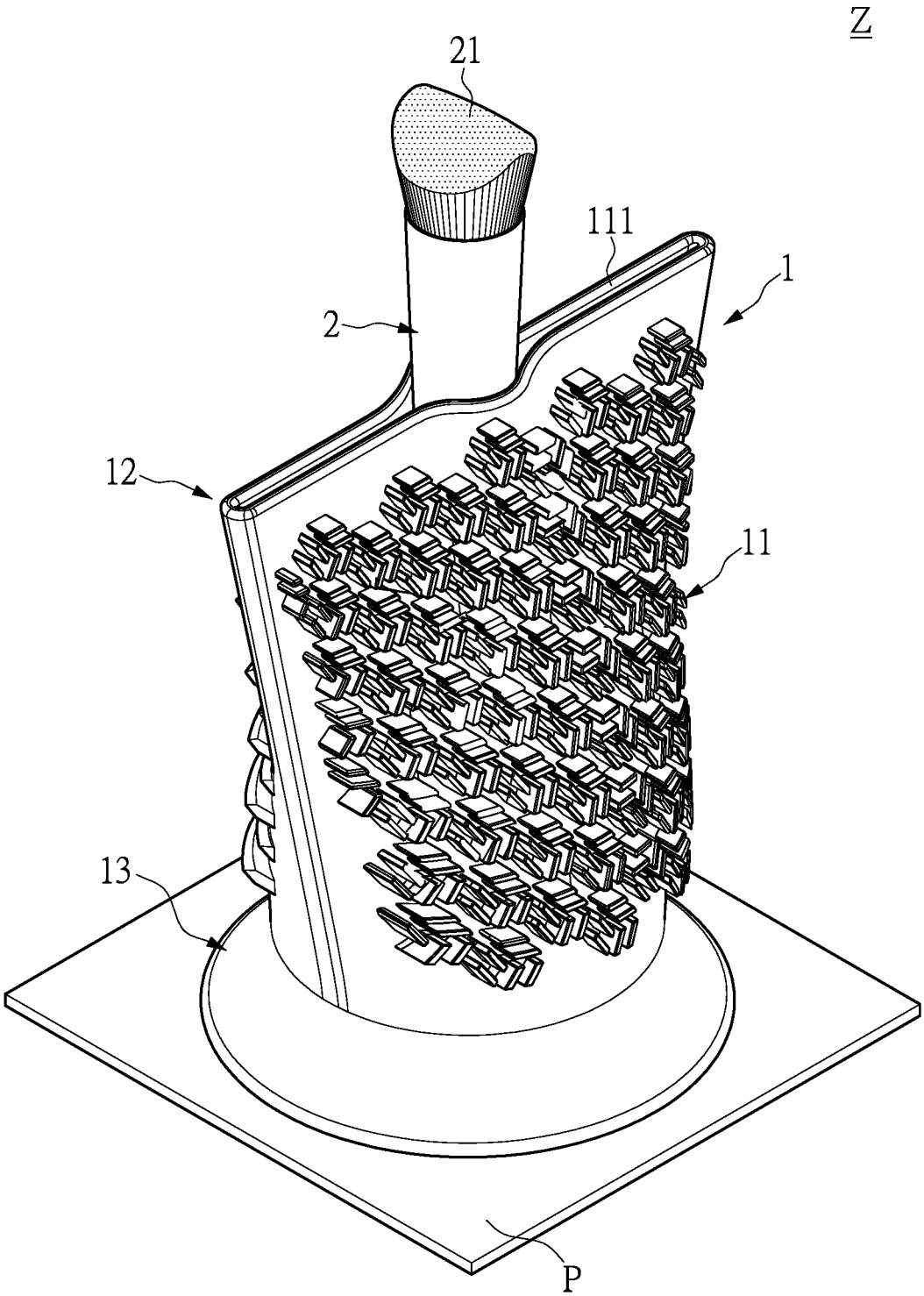
FIG. 8 is a schematic view showing still another use state of the multifunctional brush protector of the present disclosure.

Referring to FIG. 2, FIG. 7 and FIG. 8, the supporting portion 13 is formed at the second open end 112 for allowing the sleeve body 11 to be in an upright state. Furthermore, the supporting portion 13 can also restrict the movement of the brush 2 if needed. More specifically, the supporting portion 13 can include a positioning flange 131 surrounding an outer periphery of the second open end 112. The positioning flange 131 can act as a foot stand to stabilize the sleeve body 11 standing on a platform P such as a dressing table. In the present embodiment, the positioning flange 131 can be integrally formed at the second open end 112 of the sleeve body 11 and extend from an outer periphery of the second open end 112, but the present disclosure is not limited thereto.

Referring to FIG. 1 and FIG. 7, the supporting portion 13 can further include a plurality of retaining pieces 132 that are disposed at an inner periphery of the second open end 112 and extend along a radial direction. The retaining pieces 132 co-define a channel 133 therebetween and a predetermined spacing 134 is located between any two adjacent retaining pieces 132. The retaining pieces 132 have a high degree of freedom in the presence of the channel 133 and the predetermined spacings 134, so that the multifunctional brush protector 1 can easily receive the brush head 21 of the brush 2 in the accommodating space 113 through the first open end 111 and retain the holding portion 22 of the brush 2 by the retaining pieces 132.

Figure 5:
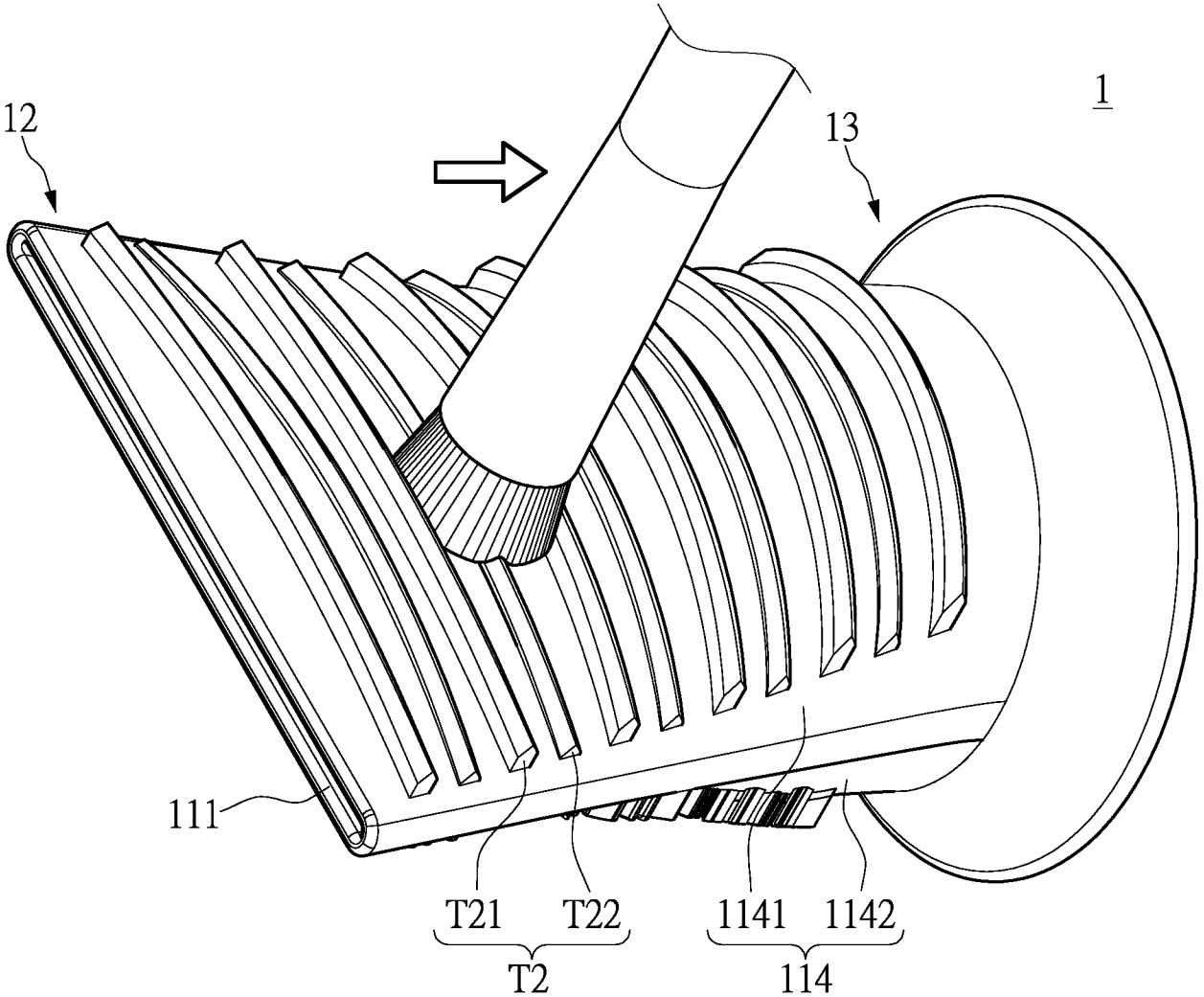
FIG. 5 is a schematic view showing another use state of the multifunctional brush protector of the present disclosure.
Figure 9:
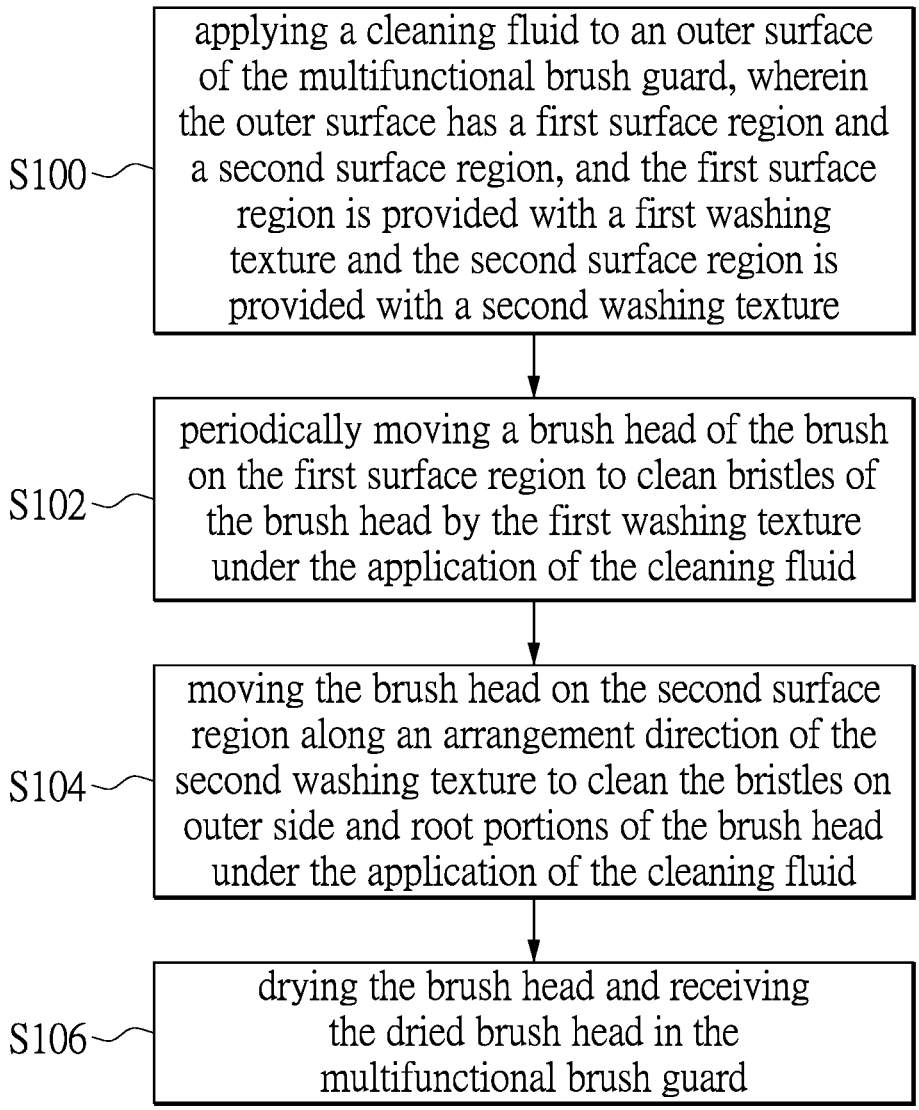
FIG. 9 is a flowchart of a method for using the multifunctional brush protector of the present disclosure.

Reference is made to FIG. 9, which is to be read in conjunction with FIG. 1, FIG. 3 and FIG. 5. In order to enable those skilled in the art to fully understand the advantages of the present disclosure, the embodiments of the present disclosure further provides a method for using a multifunctional brush protector 1 to wash a brush 2 including the following steps. The first step (i.e., step S100) is applying a cleaning fluid to an outer surface 114 of the multifunctional brush protector 1, wherein the outer surface 114 has a first surface region 1141 and a second surface region 1142, and the first surface region 1141 is provided with a first washing texture T1 and the second surface region 1142 is provided with a second washing texture T2. The next step (i.e., step S102) is periodically moving a brush head 21 of the brush 2 on the first surface region 1141 to clean brush hairs of the brush head 21 by the first washing texture T1 under the application of the cleaning fluid. The next step (i.e., step S104) is moving the brush head 21 on the second surface region 1142 along an arrangement direction of the second washing texture T2 to clean the brush hairs on outer side and root portions of the brush head 21 under the application of the cleaning fluid. The last step (i.e., step S106) is drying the brush head 21 and receiving the dried brush head 21 in the multifunctional brush protector 1.

Referring again to FIG. 1, FIG. 2 and FIG. 4, the embodiments of the present disclosure further a brush assembly Z including a multifunctional brush protector 1 and a brush 2. The multifunctional brush protector is configured to work with the brush 2 and includes a sleeve body 11, an elastic tightening portion 12 and a supporting portion 13 that are integrally formed together. The structural features of the sleeve body 11, the elastic tightening portion 12 and the supporting portion 13 have been described above and will not be reiterated herein. The brush 2 can include a brush head 21 and a holding portion 22 (e.g., handle). The brush 2 can be a foundation brush, honey powder brush or blush brush, but is not limited thereto.

It should be noted that, the brush assembly Z has multiple use states. One of the use states (e.g., cleaning state) of the brush assembly Z, as shown in FIG. 3, is that the brush head 21 of the brush 2 is cleaned by the first washing texture T1 and the second washing texture T2 of the multifunctional brush protector 1 under the application of a cleaning fluid such as water. Accordingly, cosmetics adhered on the brush head 21 can be efficiently removed. Another one of the use states (e.g., carrying state) of the brush assembly Z, as shown in FIG. 1, is that the brush head 21 of the brush 2 is received in the accommodating space 113 of the multifunctional brush protector 1 through the first open end 111, and the holding portion 22 of the brush 2 is retained by the retaining pieces 132. Accordingly, the multifunctional brush protector 1 can protect the brush hairs of the brush head 21 from being crushed or disorganized during carrying. Still another one of the use states of the brush assembly Z, as shown in FIG. 8, is that the brush 2 is placed in a standing manner by the multifunctional brush protector 1 in use to prevent the brush head 21 from coming in contact with dust, dirt and other debris. More specifically, when the sleeve body 11 is in the upright state via the supporting portion 13, the brush 2 is placed in a standing manner by the elastic tightening portion 12 while the holding portion 22 at least partially abuts an inner wall of the sleeve body 11 and the brush head 21 is exposed from the first open end 111.

One of the advantages of the present disclosure is that the multifunctional brush protector of the present disclosure, in which the sleeve body has a first open end and a second open end and an outer surface thereof is provided with a first washing texture, and the elastic tightening portion and the supporting portion are respectively formed at the first open end and the second open end and the supporting portion includes a plurality of retaining pieces that are disposed at an inner periphery of the second open end and extend along a radial direction, can increase the flexibility of use of the brush, prevent the brush head 21 from coming in contact with dust, dirt and other debris, and, before use, prevent the brush hairs of the brush head 21 from being deformed and disorganized.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A multifunctional brush protector for use with a makeup brush which includes a brush head and a holding portion connecting to the brush head, comprising:

a sleeve body having a first open end, a second open end corresponding to the first open end, and an accommodating space arranged between the first open end and the second open end, wherein the sleeve body has an outer surface provided with a first washing texture, and a width of the first open end is larger than that of the second open end;

an elastic tightening portion formed at the first open end for positioning the makeup brush; and a supporting portion formed at the second open end and including a plurality of retaining pieces that are disposed at an inner periphery of the second open end and extend along a radial direction, wherein the sleeve body is configured to be held in an upright state by the supporting portion;

wherein the multifunctional brush protector is configured to receive the brush head in the accommodating space through the first open end; when the brush head is received in the accommodating space, the brush head is restricted by the elastic tightening portion from falling out through the first open end and the holding portion is retained by the retaining pieces.

2. The multifunctional brush protector according to claim 1, wherein the sleeve body has a tapered shape along a direction from the second open end to the first open end.

3. The multifunctional brush protector according to claim 2, wherein the sleeve body increases in thickness along a direction from the second open end to the first open end.

4. The multifunctional brush protector according to claim 1, wherein the supporting portion further includes a positioning flange surrounding an outer periphery of the second open end.

5. The multifunctional brush protector according to claim 1, wherein the outer surface of the sleeve body includes a first surface region and a second surface region corresponding to the first surface region, and the first surface region is provided with the first washing texture and the second surface region is provided with a second washing texture.

6. The multifunctional brush protector according to claim 5, wherein the first washing texture includes a plurality of first washing texture units uniformly distributed on the first surface region, and each of the first washing texture units includes a plurality of tiny protrusions spaced apart from each other.

7. The multifunctional brush protector according to claim 6, wherein the number of the tiny protrusions of each first washing texture unit of the first washing texture is four, two of the tiny protrusions extend along a first direction, and the other two of the tiny protrusions extend along a second direction that is different from the first direction.

8. The multifunctional brush protector according to claim 5, wherein the second washing texture includes a plurality of convex ribs extending along a width direction of the sleeve body and spaced apart from each other.

9. The multifunctional brush protector according to claim 8, wherein the convex ribs include a plurality of first convex ribs and a plurality of second convex ribs alternately arranged with the first convex ribs, and the first convex ribs have a bigger size than the second convex ribs.

10. A brush assembly, comprising:

a makeup brush including a brush head and a holding portion connecting to the brush head; and a multifunctional brush protector configured for use with the makeup brush, wherein the multifunctional brush protector comprises:

a sleeve body having a first open end, a second open end corresponding to the first open end, and an accommodating space arranged between the first open end and the second open end, wherein the sleeve body has an outer surface provided with a first washing texture, and a width of the first open end is larger than that of the second open end;

an elastic tightening portion formed at the first open end for positioning the makeup brush; and a supporting portion formed at the second open end and including a plurality of retaining pieces that are disposed at an inner periphery of the second open end and extend along a radial direction, wherein the sleeve body is configured to be held in an upright state by the supporting portion;

wherein the multifunctional brush protector is configured to wash the brush head of the brush by the first washing texture;

wherein the multifunctional brush protector is configured to receive the brush head in the accommodating space through the first open end; when the brush head is received in the accommodating space, the brush head is restricted by the elastic tightening portion from falling out through the first open end and the holding portion is retained by the retaining pieces.

11. The brush assembly according to claim 10, wherein when the sleeve body of the multifunctional brush protector is in the upright state, the makeup brush is placed in a standing manner by the elastic tightening portion while the holding portion at least partially abuts an inner wall of the sleeve body and the brush head is exposed from the first open end.

12. The brush assembly according to claim 10, wherein the sleeve body has a tapered shape along a direction from the second open end to the first open end.

13. The brush assembly according to claim 10, wherein the sleeve body increases in thickness along a direction from the second open end to the first open end.

14. The brush assembly according to claim 10, wherein the supporting portion further includes a positioning flange surrounding an outer periphery of the second open end.

15. The brush assembly according to claim 10, wherein the outer surface of the sleeve body includes a first surface region and a second surface region corresponding to the first surface region, and the first surface region is provided with the first washing texture and the second surface region is provided with a second washing texture.

16. The brush assembly according to claim 15, wherein the first washing texture includes a plurality of first washing texture units uniformly distributed on the first surface region, and each of the first washing texture units includes a plurality of tiny protrusions spaced apart from each other.

17. The brush assembly according to claim 16, wherein the number of the tiny protrusions of each first washing texture unit of the first washing texture is four, two of the tiny protrusions extend along a first direction, and the other two of the tiny protrusions extend along a second direction that is different from the first direction.

18. The brush assembly according to claim 15, wherein the second washing texture includes a plurality of convex ribs extending along a width direction of the sleeve body and spaced apart from each other.

19. The brush assembly according to claim 15, wherein the convex ribs include a plurality of first convex ribs and a plurality of second convex ribs alternately arranged with the first convex ribs, and the first convex ribs have a bigger size than the second convex ribs.

* * * * *